United States Patent [19]

Stuckey

[11] 4,021,768

[45] May 3, 1977

[54] VARIABLE RESISTANCE CONTROL WITH MULTIPLE PADDLE CONTACTOR AND METHOD OF MAKING THE SAME

[75] Inventor: Ronald L. Stuckey, Monroe, Ind.

[73] Assignee: CTS Corporation, Elkhart, Ind.

[22] Filed: Oct. 20, 1975

[21] Appl. No.: 623,985

[52] U.S. Cl. ..... 338/180; 29/630 E; 338/183; 338/202

[51] Int. Cl.[2] ..... H01C 10/42; 29 630 E

[58] Field of Search ..... 338/202, 160–183; 200/275

[56] References Cited

UNITED STATES PATENTS

| | | | |
|---|---|---|---|
| 3,371,305 | 2/1968 | De Long et al. | 338/202 |
| 3,412,361 | 11/1968 | Lovejoy et al. | 338/183 |
| 3,569,897 | 3/1971 | Laube et al. | 338/180 X |
| 3,576,513 | 4/1971 | Mathison et al. | 338/180 |
| 3,693,062 | 9/1972 | Von Vick | 338/180 X |

*Primary Examiner*—Arthur T. Grimley
*Assistant Examiner*—David A. Tone
*Attorney, Agent, or Firm*—John J. Gaydos

[57] ABSTRACT

A variable resistance control of the rectilinear and multiturn type is provided with a contactor having a plurality of contactor paddles. The contactor paddles are wedge-shaped, are defined by a saw-tooth shaped shear line in a planar portion of the contactor, and are bent upwardly to provide flexing clearance between adjacent contactor paddles.

15 Claims, 8 Drawing Figures

VARIABLE RESISTANCE CONTROL WITH MULTIPLE PADDLE CONTACTOR AND METHOD OF MAKING THE SAME

The present invention relates to variable resistance controls, and more particularly, to a variable resistance control having a contractor containing a plurality of paddles for resiliently wiping and electrically contacting a resistance element and to a method of making such contactor.

As higher resistivities and smaller controls are being used in ever increasing numbers to meet the demand for electronic equipment containing solid-state devices increases, the problem of intermittency occurs more frequently. Presently, there is a large and increasing demand for preset variable resistance controls for trimming circuits in solid-state receivers and electronic equipment. Controls of this type are generally referred to as preset trimmers since the resistivity is adjusted at the time of manufacture of the electronic device.

Trimming a circuit requires the introduction of a resistance into the circuit until an optimum condition occurs. Since the gain of solid-state amplifier devices, the resistance of fixed resistors, the capacitance of fixed capacitors, and the impedance of fixed inductive devices all vary from their respective nominal values in production lots, the performance characteristics of electronic circuits using these electronic components preferably is optimized by the use of preset trimmers such as the type herein described. In production line and supposedly identical electronic circuits built from production line components, various resistances are still required to trim the circuit to attain optimum performance. Thus a trimmer is selected with the proper resistance range to optimize any, supposedly identical, production line circuit irrespective of the production line variations of the respective parameters of the components thereof; and, theoretically the required resistance for any particular electronic device can be obtained by positioning the contactor along the resistance element to the point wherein the required resistance for optimized performance is obtained. However, if the contactor should become partially or totally separated from the resistance element by a nonconductive particle at the point wherein the optimum resistance should be obtained, the static contact resistance becomes excessive or infinite, it becomes impossible to optimize the electronic circuit, and the preset trimmer must be replaced.

Further, during movement of the contactor along a resistance element, there is a varying resistance between the contactor and the resistance element generally referred to as dynamic contact resistance. This dynamic contact resistance is a souce of electrical noise as the circuit is trimmed. This phenomenon is more adequately described in U.S. Pat. No 3,855,565 of common assignee. Engaging a resistance element with double contacts to decrease the dynamic contact resistance is well known in the art. To decrease further the dynamic control resistance, and to improve further the reliability of achieving low static control resistance, it is advantageous to maximize the number of contactor paddles engaging the resistance element; however, variable resistance controls of the rectilinear and multiple turn type are extremely compact and this compactness presents a problem in the design and fabrication of the contactor paddles.

Accordingly, it is an object of the present invention to provide a variable resistance control having a contactor that includes a plurality of contactor paddles contacting a resistance element and to a method of making the same. Another object of the present invention is to provide a variable resistance control having a contactor that includes both a plurality of contactor paddles contacting the resistance element and a plurality of contactor paddles contacting a collector element. A further object is to provide a contactor for a variable resistance control of the aforementioned type that includes a maximum number of contactor paddles for a given size of contactor. Still another object of the present invention is to provide a contactor in which the contactor paddles are defined by a saw-tooth shaped shear line and the contactor paddles are preformed to provide working clearance between adjacent contactor paddles. Another object is to provide a method for the fabrication of contactor paddles in a contactor by shearing a saw-tooth shaped shear line and forming a plurality of contactor paddles. Further objects and advantages of the present invention will become apparent as the following description proceeds and features of novelty characterizing the invention will be pointed out with particularlity in the claims annexed to and forming a part of this specification.

Briefly, the present invention is concerned with a variable resistance control having a contactor that includes a plurality of contactor paddles for wiping the surface of an elongated resistance element. The contactor comprises a piece of electrically conductive spring sheet metal having a saw-tooth shaped shear line therein and having a plurality of contactor paddles preformed from adjacent and oppositely disposed wedge-shaped portions or fingers which are defined by the saw-tooth shaped shear line. Since these finger-shaped portions are tapered, being wider near the point of attachment to the contactor, and being narrower toward the severed end thereof, working clearance between adjacent ones of the contactor paddles is achieved by bending these wedge-shaped portions in such a manner that the narrow ends thereof are moved distal from respective ones of the sheared edges of adjacent wedge-shaped portions.

For a better understanding of the present invention, reference may be had to the accompanying drawings wherein the same reference numerals have been applied to like parts and wherein.

Figure 1:
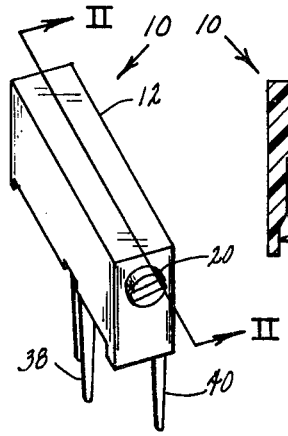
FIG. 1 is an isometric view of a variable resistance control made in accord with the present invention.
Figure 2:
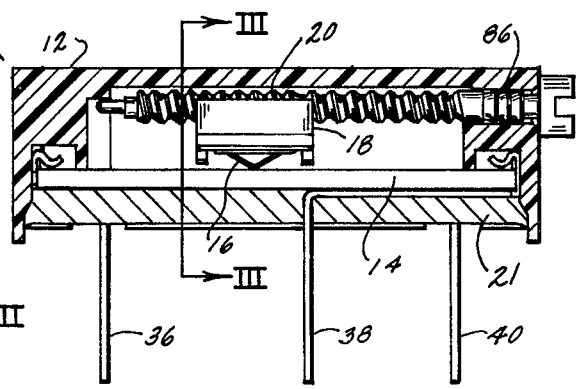
FIG. 2 is an enlarged sectional view taken along line II—II of FIG. 1.
Figure 3:
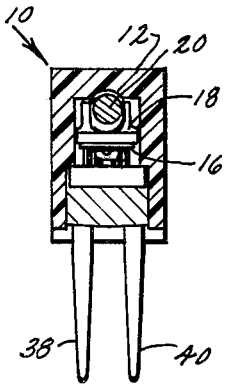
FIG. 3 is a sectional view taken along line III—III of FIG. 2 assuming that FIG. 2 is shown in full.
Figure 4:
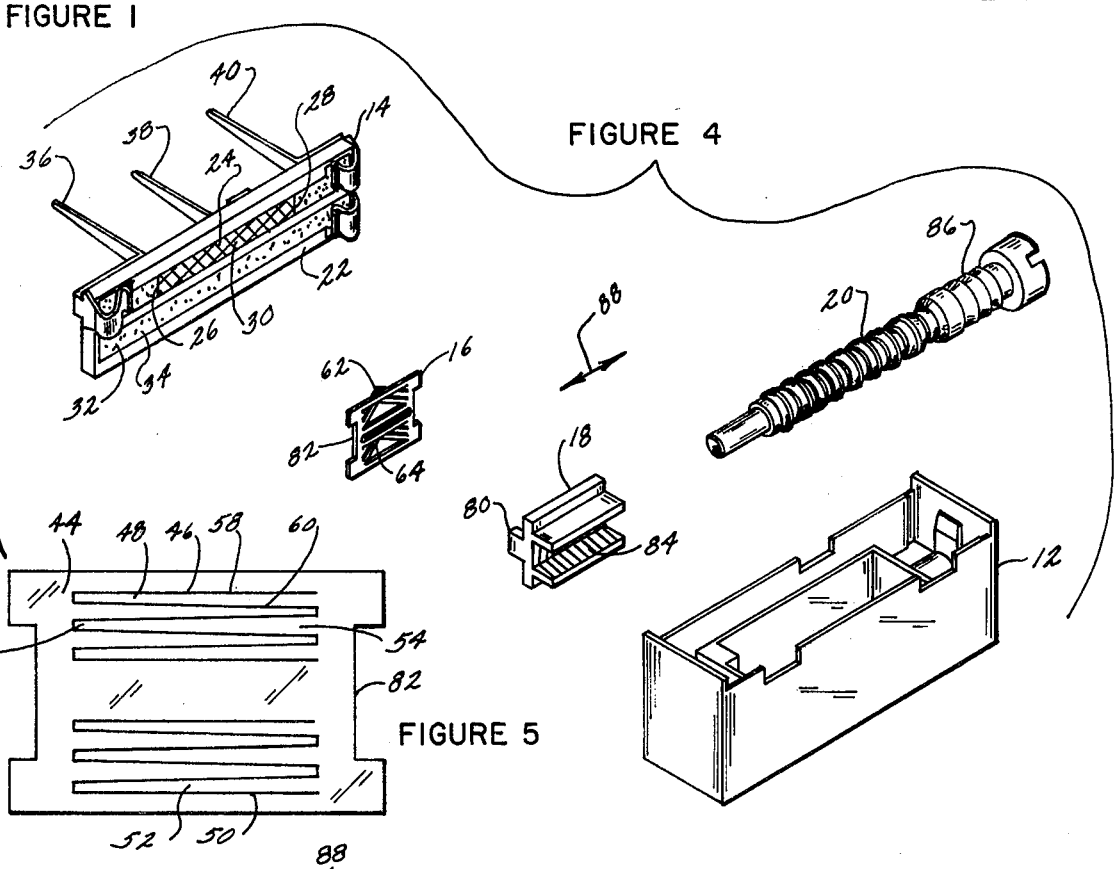
FIG. 4 is an exploded view of the control shown in FIGS. 1–3 but without the sealing material.

Referring now to the drawings, and more particularly to FIGS. 1–4, there is illustrated a variable resistance control of the rectilinear and multiturn type, generally indicated at 10. The variable resistance control 10 includes a housing 12, a base subassembly 14, a contactor 16, a driver 18 and a lead screw 20. A suitable sealing material 21, such as epoxy, effectively seals the base subassembly 14 to the housing 12.

The base subassembly 14 comprises a substrate 22, a resistance element 24 deposited on the substrate and including a first end 26 and a second end 28 with a first contactor surface 30 therebetween, a collector element 32 having a second contactor surface 34 thereon, a first terminal 36 attached to the substrate 22 and electrically contacting the first end 26 of the resistance element 24, a second terminal 38 attached to the substrate 22 and electrically contacting the collector element 32, and a third terminal 40 connected to the substrate 22 and electrically contacting the second end 28 of the resistance element 24.

Figure 5:
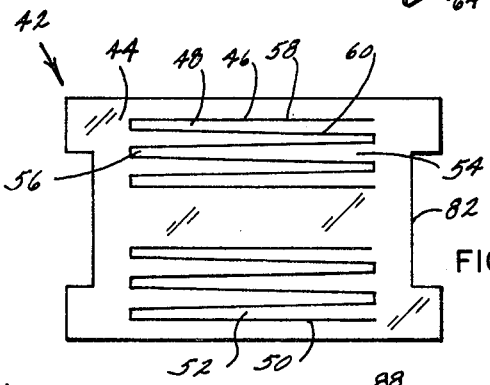
FIG. 5 is a flat pattern view of the contactor shown in FIG. 4 before forming of the contactor paddles.
Figure 6:
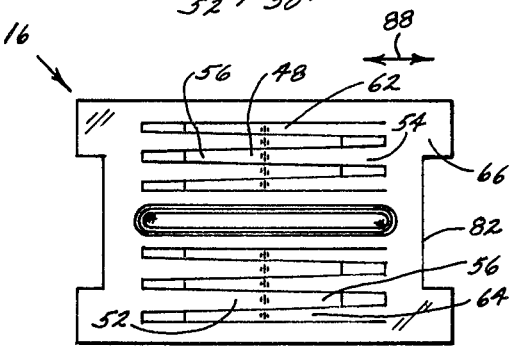
FIG. 6 is a top plan view of the contactor shown in FIG. 5 after forming of the contactor paddles.
Figure 8:
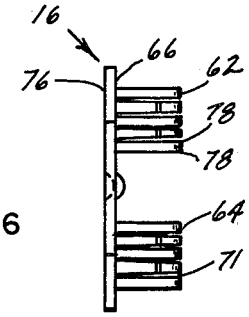
FIG. 8 is an end view of the contactor shown in FIG. 6.
Figure 7:
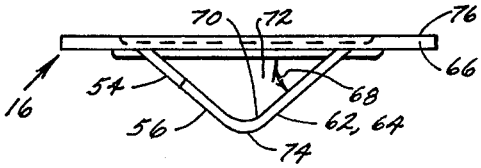
FIG. 7 is a side view of the contactor shown in FIG. 6.

Referring now to FIGS. 5–8, and more particularly to FIG. 5, a contactor blank 42 of a suitable material such as beryllium copper includes a planar portion 44, a first saw-tooth shaped shear line 46 defining a plurality of wedge-shaped portions or fingers 48, and a second saw-tooth shaped shear line 50 defining a second plurality of wedge-shaped portions or fingers 52. Each of the wedge-shaped fingers 48 and 52 includes a wide end 54 integral with the planar portion 44, a narrow end 56 severed from the planar portion 44, a first side 58 severed from an adjacent one of the fingers 48 or 52 or the portion 44, and a second side 60 sheared from an adjacent one of the fingers 48 or 52 or from the planar portion 44. As best seen in FIGS. 6 to 8, the contactor blank 42 of FIG. 5 has been formed into the contactor 16. The fingers 48 and 52 have, respectively, been performed or bent out of the plane of the portion 44 to form a first plurality of contactor paddles 62 and a second plurality of contactor paddles 64. Each of the contactor paddles 62 and 64 have been bent or formed upwardly from the upper surface 66 of the portion 44 by an acute-angle upward bend 68 proximal to the respective integral wide end 54 and each of the contactor paddles 62 and 64 has been bent or formed downwardly toward the upper surface 66 by a downward bend 70 to form an inverted V-shape 72 and a convex contacting surface 74. The portions of the fingers 48 and 52 intermediate of the respective wide ends 54 and narrow ends 56 define, after forming, the raised portion of each of the contactor paddles 62 and 64. Preferably, and in accord with the present invention, the acute-angle upward bend 68 and the downward 70 effectively shift respective ones of the narrow ends 56 of the fingers 48 and 52 distal from the wide ends 54 of the adjacent fingers 48 or 52 so that clearance space 71 is provided between adjacent contactor paddles 62 and 64 for flexing toward and away from a lower surface 76 of the contactor 16. Three-dimensional curved or spherical surfaces 78 (see FIG. 8) are coined, or formed by other suitable operations, onto each of the contactor paddles 62 or 64 to eliminate any burrs from the sides 58 and 60 thereof.

Referring again to FIGS. 1 to 4, the first plurality of contactor paddles 62 engage the first contactor surface of the resistance element 24 and the second plurality of contactor paddles 64 engage the second contactor surface of the collector element 32. The driver 18 includes a pair of lugs 80 received in a pair of notches 82 in the contactor 16 and the lead screw 20 longitudinally maintained within the housing 12 by a burr 86, drivingly engages a plurality of threaded grooves 84 in the driver 18. Rotation of the lead screw 20 effectively moves the contactor 16 in the directions of motion as indicated by a double-headed arrow 88, and selectively positions the first plurality of contactor paddles 62 along the contactor surface 30 of the resistance element 24.

The method of manufacturing the contactor 16 includes shearing the saw-tooth shaped shear lines 46 and 50 into the planar portion 44 of blank 42 intermediate of the edges thereof, and substantially orthogonal to the direction of motion as indicated by arrow 88 of the contactor 16, to form the plurality of adjacent and oppositely disposed wedge-shaped fingers 48 and 52. Each of the fingers has the wide end 54 integral with the planar portion 44, the narrow end 56 severed from the planar portion 44 and from adjacent ones of the fingers 48 and 52 and each finger has sides 58 and 60 disposed at acute angles to the direction of motion as indicated by arrow 88. After shearing the blank 42 is formed by bending each of the fingers 48 and 52 upwardly proximal to the wide ends 54 thereof by the acute-angle upward bend 68 and bending each of the ends of the fingers 48 and 52 downwardly equidistant of respective ones of the wide ends 54 to form the plurality of contactor paddles having inverted V-shape 72 and having a contact-surfaces 74 thereof in a straight line orthogonal to the direction of motion as indicated by arrow 88.

In summary, the contactor 16 of the present invention provides a maximum number of contactor paddles 62 and 64 in a given size space because the contactor paddles are formed from a total area, as defined by saw-tooth shaped shear lines 46 and 50, no material being blanked and removed from between the fingers 48 and 52. Instead the unique tapered shape of the fingers 48 and 52, as combined with the oppositely disposed positioning of adjacent fingers and the forming of the fingers into the contactor paddles effectively provides the clearance space 71 between proximal sides of adjacent paddles, as defined by the shear lines 46 and 50 without removal of stock therebetween.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. In a variable resistance control, the combination of a resistance element having first and second ends and a first contactor surface therebetween, a first terminal electrically connected to the resistance element proximal to one of the ends, a collector element having a second contactor surface and being in spaced relationship to the resistance element, a second terminal electrically connected to the collector element, a contactor electrically engaging the first and second contactor surfaces, means for moving the contactor along a predetermined path to engage the first contactor surface at selective distances from the first terminal, the contactor comprising a piece of sheet metal having a planar portion including an upper surface, and a plurality of integral contactor paddles providing electrical engagement of the contactor with one of the contactor surfaces, the contactor paddles being wedge-shaped fingers defined by a first saw-tooth shaped shear line disposed in the planar portion and disposed substantially orthogonal to the direction of motion of the contactor along said predetermined path, each of the paddles having a wide end integral with the planar portion and substantially orthogonal to the direction of motion and a severed narrow end, each of the paddles having a first side extending from the wide end thereof to the narrow end thereof at an acute angle to the direction of motion and severed from one of the sides of an adjacent wedge-shaped finger by the shear line, each of the paddles having a severed second side extending from the wide end thereof to the narrow end thereof and a raised portion extending upwardly from the upper surface providing a portion of the electrical engagement of the plurality of contactor paddles with one of the contactor surface.

2. The resistance control of claim 1, wherein the raised portions comprise an acute-angle first bend of each of the wedge-shaped fingers proximal to respective ones of the wide ends and substantially orthogonal to the direction of motion, and a second bend of each of the wedge-shaped fingers intermediate of the wide and narrow ends and substantially orthogonal to the direction of motion.

3. The resistance control of claim 2, wherein the second bends are disposed equidistant between respective and adjacent ones of said wide ends.

4. The resistance control of claim 2, wherein the raised portions each include a contacting surface comprising a portion of the upper surface as defined by respective ones of the wedge-shaped fingers and by respective ones of the second bends, and a pair of three-dimensional curved surfaces being intermediate of respective ones of the sides and respective ones of the contacting surfaces of the contactor paddles.

5. The resistance control of claim 1, wherein the resistance control is of the rectilinear, multiturn type, the means for moving comprises a lead screw operatively engaging a driver, the driver operatively engaging said contactor, the one contactor surface comprises the first contactor surface, the contactor includes a second plurality of contactor paddles providing the electrical engagement with the second contactor surface and comprises a second plurality of wedge-shaped fingers defined by a second saw-tooth shaped shear line disposed in the planar portion and in line with the first saw-tooth shaped shear line, each having a wide end integral with the planar portion and substantially orthogonal to the direction of motion, each having a severed narrow end, each having a severed first side extending from the wide end thereof at an acute angle to the direction of motion, each having a severed second side extending from the wide end thereof to the narrow end thereof, and each having a raised portion extending upwardly from the upper surface and providing a portion of the electrical engagement of the second plurality of contactor paddles with the second contactor surface, the raised portions of all of the contactor paddles comprising an acute-angle upward bend of each of said wedge-shaped fingers proximal to respective ones of the wide ends and substantially orthogonal to the direction of motion, and a downward bend of each of the wedge-shaped fingers equidistant between respective and adjacent ones of the wide ends and substantially orthogonal to the direction of motion, each of the raised portions of both of the pluralities of wedge-shaped fingers including a contacting surface comprising a portion of the upper surface as defined by respective ones of the wedge-shaped fingers and by respective ones of the second bends.

6. In a variable resistance control of the type that includes a resistance element having first and second ends and a first contactor surface therebetween, a first terminal being electrically connected to the resistance element proximal to one of the ends, a collector element having a second contactor surface and being in spaced relationship to the resistance element, a second terminal being electrically connected to the collector element, a contactor electrically engaging the first and second contactor surfaces, and means for moving the contactor along a predetermined path to engage the first contactor surface at selective distances from the first terminal, the improvement comprising the contactor comprising a piece of sheet metal having a planar portion operatively engaging the means and having a plurality of integral contactor paddles providing electrical engagement of the contactor with one of the contactor surfaces, the contactor paddles comprising a plurality of wedge-shaped fingers defined by a saw-tooth shaped shear line disposed in the planar portion and disposed substantially orthogonal to the direction of motion of the contactor along the predetermined path, each of the paddles having a raised portion extending from a surface of the planar portion and providing a portion of the electrical engagement of the plurality of contactor paddles with the one of the contactor surfaces.

7. The resistance control of claim 6, wherein the contactor includes a second plurality of contactor paddles providing the electrical engagement of the contactor with the other of the contactor surfaces.

8. An electrical contactor for a variable resistance control comprising a piece of sheet metal having a planar portion including upper and lower surfaces, a first saw-tooth shaped shear line in the planar portion defining a plurality of adjacent and oppositely disposed wedge-shaped fingers, each of the fingers including both a narrow end and a pair of sides severed from the planar portion and from adjacent one of the fingers by the shear line, each of the fingers including a wide end integral with the planar portion and proximal to a narrow end of an adjacent one of the wedge-shaped fingers having an acute-angle upward bend proximal to the wide end thereof and a downward bend intermediate of the wide and narrow ends thereof, both bends being substantially orthogonal to a line bisecting the pair of sides thereof whereby the bends are effective to move each of the narrow ends distal from adjacent ones of the wide ends thereby effectively providing clearance between adjacent sides of the wedge-shaped fingers that are defined by the shear line and thereby providing clearance space for individual flexing of the wedge-shaped fingers toward and away from the upper surface.

9. The electrical contactor as claimed in claim 8, wherein the downward bends are disposed substantially equidistant between respective and adjacent ones of the wide ends.

10. The electrical contactor as claimed in claim 8, wherein each of the wedge-shaped fingers includes a contacting surface comprising a portion of the upper surface as defined by respective ones of the downward bends, and a pair of three-dimensional curved surfaces being intermediate of respective ones of each of the contacting surfaces and respective ones of the sides.

11. The electrical contactor as claimed in claim 8, wherein the downward bends are disposed substantially equidistant between respective and adjacent ones of the wide ends, each of the wedge-shaped fingers includes a contacting surface comprising a portion of the upper surface as defined by respective ones of the downward bends, a pair of three-dimensional curved surfaces being intermediate of respective ones of each of the contacting surfaces and respective ones of the sides, the electrical contactor includes a second saw-tooth shaped shear line being disposed in the planar portion, being in line with the first saw-tooth shaped shear line, and defining a second plurality of wedge-shaped fingers including integral wide ends and severed narrow ends, an acute-angle upward bend in each of the second plurality of wedge-shaped fingers proximal to the wide ends thereof, and a downward bend in each of the second plurality of wedge-shaped fingers being disposed equidistant between respective and adjacent ones of the wide ends.

12. A method of producing a multipaddle electrical contactor for a variable resistance control comprising the steps of:

a. shearing a saw-tooth shaped shear line into a planar portion of sheet metal intermediate of the edges thereof, to form a plurality of adjacent and oppositely disposed wedge-shaped fingers, each of the fingers having a wide end integral with the planar portion and having both a narrow end and side edges severed from the planar portion and from adjacent ones of the wedge-shaped fingers by the saw-tooth shaped shear line, and b. forming an upwardly raised portion in each of the wedge-shaped fingers.

13. The method as claimed in claim 12, wherein the forming step comprises three-dimensional contouring of a portion of each of the raised portions, upward distal from the planar portion, thereby providing smooth and burr-free contacting surfaces.

14. The method as claimed in claim 12, wherein the forming step comprises:

a. bending each of the wedge-shaped fingers upwardly proximal to the wide end thereof, and b. bending each of the wedge-shaped fingers downwardly intermediate of the wide and narrow ends thereof, to form a plurality of contactor paddles each having the raised portion.

15. The method as claimed in claim 14, wherein the forming step comprises forming of the raised portion beyond the midpoint of each of the fingers but equidistant between respective and adjacent ones of the ends.

* * * * *